United States Patent [19]

Parker

[11] Patent Number: 4,536,753

[45] Date of Patent: Aug. 20, 1985

[54] SELF MONITORING INTRUDER DETECTING SYSTEM OF NOISE-CANCELLING VIBRATION DETECTORS

[75] Inventor: William H. Parker, Hurst, Tex.

[73] Assignee: Del Norte Technology, Inc., Euless, Tex.

[21] Appl. No.: 404,406

[22] Filed: Aug. 2, 1982

[51] Int. Cl.[3] ..... G08B 13/10

[52] U.S. Cl. ..... 340/566; 181/122; 367/93

[58] Field of Search ..... 340/566; 181/122; 367/93

[56] References Cited

U.S. PATENT DOCUMENTS

| | | | |
|---|---|---|---|
| 3,806,909 | 4/1974 | Bound | 340/566 |
| 4,107,660 | 8/1978 | Chleboun | 340/566 |
| 4,374,378 | 2/1983 | Lee | 340/566 |

*Primary Examiner*—Glen R. Swann, III

*Attorney, Agent, or Firm*—Louis Bernat

[57] ABSTRACT

A ferrite transformer is coupled between a two-wire array of geophones or other suitable vibration detectors (such as hydrophones). An oscillator is coupled across the secondary of the transformer in order to provide a carrier on which the output of the array may be modulated. A low level leakage current appears in the array so that a continuity test may be conducted to monitor the line for opens and shorts and to detect the operativeness of system components. The modulated output of the transformer is connected to a signal processing system.

8 Claims, 8 Drawing Figures

SELF MONITORING INTRUDER DETECTING SYSTEM OF NOISE-CANCELLING VIBRATION DETECTORS

BACKGROUND

This invention relates to intrusion detector systems and more particularly to systems using geophone or seismometer detectors connected together in a noise cancelling network configuration.

A geophone or seismometer is a vibration sensitive device which may be implanted on or in the earth to generate electrical signals when the earth moves. Therefore, if an intruder enters a geophone protected area, the resulting earth movements shake these devices and they generate an electrical signal to give an alarm.

A difficulty with this type of system is that it also responds to natural vibration sources, such as earth tremors, thunderclaps, and the like. Since natural sources move all geophones coherently, the resulting signals are additive. Thus, it is necessary to discriminate between the local disturbances which are caused by an intruder and the wide area general disturbances, which occur responsive to natural causes.

Historically, geophones have been connected in arrays where an in-phase excitation or vibration produces additive signals, as several detectors are shaken in-phase. This system is satisfactory when the source of earth vibrations is a signal which is additive, as when the vibrations emanate from the interior of the earth. These types of arrays are also able to cancel horizontally propagating signals, when the signals are within a frequency band which is subject to an out-of-phase addition in the array.

Unfortunately, an array of geophones which is connected additively produces an overwhelming noise because all geophones hear the same noise. The noise adds while cancelling or absorbing the desired individual detector output. While an array which is additively connected can cancel end-on noise travelling along the length of the array, the directionality of the array is contrary to the usual deployment needs for intruder detectors.

Arrays almost always lie along the perimeter of the area which is to be protected. Often the perimeter is also close to a public road where traffic produces noise which activates the array. Thus, an undesired noise is augmented by the many in-phase detectors. Such a system is not optimized, even when offsetting "noise-cancelling" detectors are set out. A parallel array may be offset, parallel to the primary array in order to give a 3 dB noise-cancelling effect at a given frequency. However, such an offset system can not salvage an otherwise poor situation. Meanwhile, the array produces large noise signals, as when a thunderstorm produces lightning and thunderclaps which drive all detectors in-phase, as the air shock strikes the ground.

SUMMARY OF INVENTION

The present invention avoids this historic application of additive geophones because the desired signals come from a disturbance which occurs at only one point in the array. The use of many arrayed devices is a convenient connection to reduce the number of process amplifiers in the total system, but the contribution of only one detector is desirable. If all other detectors in an array are not contributors, the extra detectors should not add to the noise envelope.

Accordingly, an object of the invention is to provide new and improved intruder detecting systems. In particular, an object is to provide geophone systems which are connected to cancel general noise. Conversely, an object is to enable a localized response to intruders while rejecting response to general noise such as shock waves caused by thunderclaps, lightening, or the like.

Another object of the invention is to provide fault detection for an intruder system of the described type.

In keeping with an aspect of the invention, these and other objects are accomplished by coupling a ferrite transformer between a two wire array of geophones or other vibration detectors. An oscillator is coupled across the secondary of the transformer in order to provide a carrier on which the output of the array may be modulated. A low level leakage current appears in the array so that a continuity test may be conducted to monitor the line for opens and shorts and to detect the operativeness of system components.

Transformers are elemental means for reducing common-mode current caused by ground loops. A handy primer on this subject is "*Grounding and Shielding Techniques In Instrumentation*", by Ralph Morrison, John Wiley and Sons, 1967, Library of Congress catalog card number 67-27274. The common-mode characteristics are defined on page 57–58. The transformer is used in a range of frequencies where the transformer is substantially lossless to the modulating frequency and is substantially lossy to powerline frequency and harmonics thereof which are not wanted in the process. The powerline frequency is an alien noise which is not generated in the vibration detectors. Page 61 of the Morrison book shows a precursor of the inventive system where a modulator is used to parametrically excite a transformer.

This Morrison scheme has been used in low-noise, low frequency amplifiers and is not used in the invention because it is far too expensive for practical circuits. At the present, the Morrison circuit costs about ten times more than the inventive circuit costs. Also, Morrison's circuit requires a large number of interconnecting wires that must be properly connected, which is labor intensive and expensive. By way of contrast, the invention uses a two-conductor circuit which does not depend on a polarity, similar to the polarity of a generalized telephone circuit connected to one telephone instrument. Modern ferrite technology makes a local modulator unnecessary. Moreover, ferrite is better because it is lossy at powerline frequency, such as 50 or 60 Hz, since it has a small size and has a low permeability, all of which improve the rejection of unwanted powerline components. Finally, the Morrison circuit requires a precise balancing of stray inductance and capacitance. This need for balancing is reduced by the simple process of the invention.

BRIEF DESCRIPTION OF DRAWINGS

A preferred embodiment of the invention will be understood from the attached drawings wherein.

DETAILED DESCRIPTION

Figure 1:
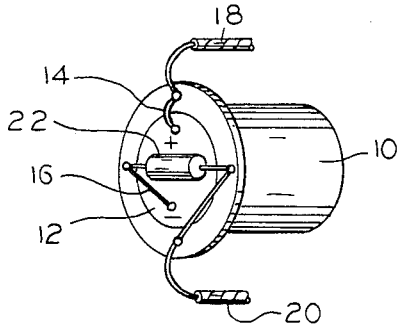
FIG. 1 is a perspective view of an exemplary geophone.

The physical configuration (FIG. 1) of a geophone is a can 10 having a sealed end 12 with wires 14, 16 extending from equipment inside the can 10 to terminals which may be electrically connected to cables 18, 20. A capacitor 22 is connected in series with each geophone 12 to block direct current through the geophone, while providing an AC coupling for the vibration caused signals. Plus(+) and minus(−) marks are formed on the end of the can to show the polarity of the geophone.

Figure 2:
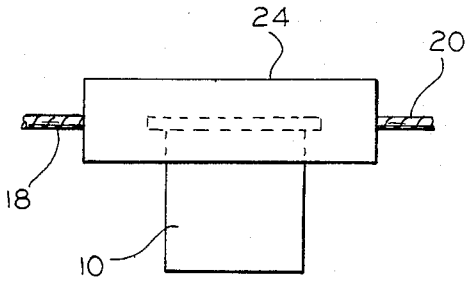
FIG. 2 is a side view which shows one geophone connected into a cable.

FIG. 2 shows that a rubber jacket 24 may be vulcanized over the cable and the end of the geophone to give a mechanically strong and weatherproof cable array which may be laid down on the surface of the earth.

Figure 3:
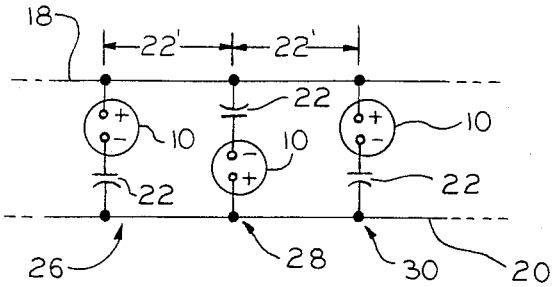
FIG. 3 schematically shows how a plurality of geophones may be connected into a cable.

FIG. 3 schematically shows three of the geophones 10 connected across cables 18, 20 with a uniform spacing, here 22-feet. The polarity of each of the geophones is reversed with respect to its neighboring geophones. Therefore, a wide area disturbance produces cancelling signals of opposing polarities. The poor results of prior geophone arrays may be improved substantially simply by connecting alternating detector geophones (or hydrophones) in series-opposing, or parallel-opposing, as shown in FIG. 3 at distributed intervals 26, 28, and 30 (here the interval is 22-feet). An array of any length may be made so that there will be no more than one extra detector. In this array, adjacent detectors generate opposing and cancelling currents when excited by seismic or other broad-wavefront noise signals, resulting in an overall reduction of remanent noise. As a result, the array produces lower noise signals and gives an improvement in the signal-to-noise ratio and this, in turn, enables the processor gain to be increased.

The probability of intruder registry or reporting is increased because the increase in processor gain means that each detector in the array is more sensitive than it was before. Therefore, the system operating at a higher gain is much more likely to report the pressure and vibration excitation caused by a footstep, or the like, at the detector. There is no point in summing the gain from only several detectors since the intruder caused disturbance is so localized that the signals are below the noise threshold if contributed from any detector which is more than a few feet away, in most cases.

Figure 4A:
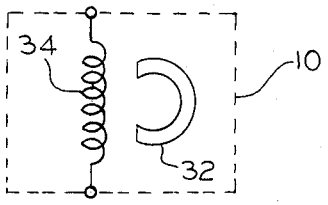
FIG. 4A is a schematic side elevation showing how a geophone is constructed and FIG. 4B is the symbol used in electronic circuit diagrams to identify a geophone.
Figure 4B:
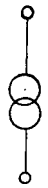

An exemplary geophone is shown in FIG. 4A, and the symbol used to represent that geophone is shown in FIG. 4B.

The seismometer (or hydrophone) of FIG. 4A is designed for detecting and reporting the passage of an intruder in a protected area. As here shown, the geophone is a miniature current generator comprising can 10 containing a magnet 32 surrounded by a loosely suspended coil 34 of wire. All of the parts in the geophone move in response to an acceleration of the earth in the immediate area where the detector is buried. The generator in the geophone produces a current which is proportional to the acceleration of the coil 34 of wire relative to magnet 32 and the can or body 10 of the geophone. The wire coil 34 is usually connected to a band filtered amplifier and, subsequently, to an electronic detection circuit which reproduces the signal generated responsive to a mechanical excitation of the generator. These seismometer detectors may also be mounted on fences, roofs, and any similar locations where vibrations may occur.

Means are provided for monitoring a system for faults which may occur in the cable connected array of geophones. In greater detail, FIG. 5 showns an exemplary embodiment of the novel geophone array 40 connected into a circuit that contains provision for sensing faults in the cable 18, 20, which connects the array of geophones to a suitable processor.

The cable connected array 40 is similar to that shown in FIG. 3. The cable 18, 20 is connected to a conventional differential amplifier 42 which produces a current in resistor 44 that is proportional to the signal received from the geophone array. This varying signal loads capacitor 46 and causes a fluctuating voltage which transfers, as an impedance change, through a diode rectifier bridge 48 to transformer 50. Transformer 50 is also excited by an oscillator 52 operating at a frequency which is much higher than the frequency of any likely signal from the array. The oscillator output is applied through differential driver amplifier 54, which may have an output impedance of approximately 50 to 200 ohms, for example.

The modulator means (42 and associated elements) is coupled to the secondary winding of transformer 50. In greater detail, the signal transmitted from the geophone cable through differential amplifier 42 to transformer 50 causes amplitude fluctuations which are superimposed on the output of the driver amplifier 54 (i.e. the high frequency of oscillator 52). Thus, the geophone produced signal modulates the carrier formed by the oscillator output the half cycles of which become a digital signal that is processed in the remaining system. The inverting amplifier 56 presents a differential signal so that the fluctuations in the resistors 58 and 60 are combined in an additive manner. A remanent drive signal appears at the input of a demodulator composed of buffer amplifier 62, diode 64, and integrating capacitor 66. There the demodulated signal fluctuations are stripped of the remanent driver modulation signal and are recovered across capacitor 66, which is drained to ground via resistor 68. Thus, a replica of the original signal appears at the input of the amplifier 70. The amplified signal 72 is further processed by any suitable means (not shown) such as a filtering and threshold detector, known to those skilled in the art.

Figure 5:
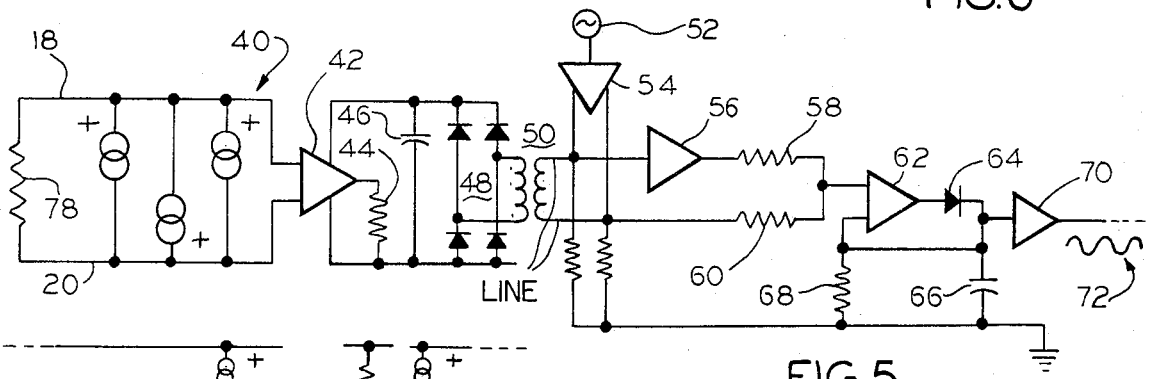
FIG. 5 is a schematic circuit diagram of a cable array of geophones and a fault detector for monitoring the performance of the cable array.

FIG. 5 is particularly directed to a novel connection in and about transformer 50. Heretofore, geophysical transformers were made of iron laminations which tended to respond to power-line frequencies, much as an antenna response described by Hertzian theory. Iron has been used because iron laminations pass seismic signals of a frequency which is a much lower frequency than the power-line frequencies. This tendency to pick up power-line frequencies requires a shielding of the transformer core. Consequently, there was a high expense.

The present transformer 50 preferably uses a ferrite core, which is a suitable material for the upper-audio frequency range generated by oscillator 52. The ferrite transformer 50 adequately couples the upper-audio frequency power from the driver amplifier 54 to rectifier bridge 48 and capacitor 46. This rectified power becomes the dc power supply for the modulating amplifier 42. Also, the transformer 50 couples the desired signal on a simple nonpolarized pair of wires without responding to stray electromagnetic fields caused by the power line, because the ferrite core does not respond to power-line frequencies.

Transformer 50 may also be air-coupled, but there might be a possible loss of optimum coupling efficiency, if the drive frequency is adjusted to optimize the transformer. Those who are skilled in the art may also find several other ways to implement this aspect of the invention.

The noise caused by leakage to ground could become so large that it might constitute an unmanageable condition, thereby leading to an inoperative system. Transformer 50 prevents such noise by effectively isolating any ground-loop currents. An isolation of some 100 dB is a practical result, which is a necessary feature of any system, such as this, which may be buried in the ground for several years with no expectation of maintenance. Primarily, the system must function without maintenance due to the excessive costs required to dig it up.

The inventive circuit can accept a worst-case conditioning of ground leakage of zero ohms on either one of the two wires inter-connecting the array and the modulator, with no detrimental effect on the operating system. For years, those who are skilled in the use of geophysical instrumentation have used iron transformers, differential amplifiers and the like, all of which lead to unacceptable costs. Moreover, prior-art connections do not give exemplary common-mode rejection and, at the same time they do not provide tamper-proof connection, as shown in FIG. 6.

Figure 6:
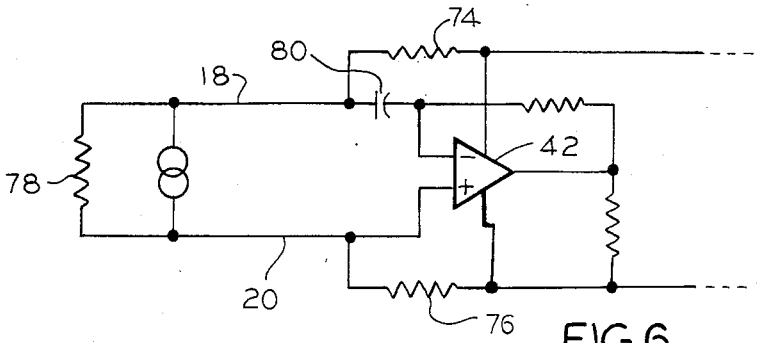
FIG. 6 is a modification of the circuit of FIG. 5 which makes the system tamper-proof.

FIG. 6 shows detailed connections of the present array to the amplifier 42. Resistors 74 and 76 are connected between the power supply and lines 18,20 to supply power and produce a low level loop current in the array.

A termination means, in the form of resistor 78, is connected across the line pair to enable a low level leakage current to flow around the loop formed by the two wire pair 18, 20 for providing a continuity test, which demands a continuous wire extending throughout the array. The low level loop current returns to the power supply through resistor 76 and output capacitor 46 (FIG. 5).

If there is a cable break, the loop current terminates to cause a bias change at amplifier 42. That change propogates through the system to produce a tremendous output signal at the output of the amplifier 70, which is easily detected and reported as a cable fault.

Cable shorts by pass resistor 78 to short circuit the two inputs to amplifier 42 and cause either a substantially zero signal out of amplifier 70, or signal 72 will substantially disappear. Either way, the short circuit caused disappearance of the signal is indicated by a loss of background noise. The sudden absence of noise could also occur if amplifier 42 fails, which in itself is an indication of a faulty system. Either way, this condition is readily detected by any suitable means such as a power energy detector, known to those who are skilled in the art.

Such a reporting of either cable short-circuit or an open cable condition is a low-priority minor alarm which can be reported well in advance of an actual intrusion and separately from major alarm signal events. Since both shorts and opens are reported, the array is made tamper-proof by an anti-tamper feature that does not detract from other system considerations. This anti-tamper feature is transparent insofar as signals transmitted through the coupling transformer 50 are concerned.

Accordingly, the transformer has at least four and probably five combinations of uses, which are:

1. a power source for differential amplifier 42
2. a signal path from the geophone array to the signal processor
3. an open-cable indicator, which gives a full-scale output if the cable is broken
4. a shorted cable indicator, which is indicated by a sudden absence of array noise.

Since an amplifier 42 failure may be detected, it might be construed as a fifth use of transformer 50. In any event, the system reports faulty operation so that remedial action can be taken.

Figure 7:
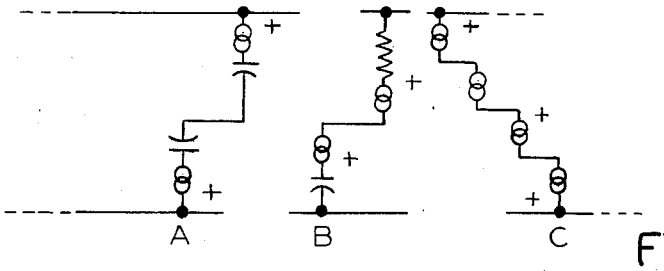
FIG. 7 shows three alternative ways of connecting the geophones into the cable without changing the functioning results in any significant manner.

The geophone detectors may be connected in other ways and still provide an array with the inventive noise-cancelling results. For example, FIG. 7 shows three alternative connections where two or more geophones are connected in series across the lines 18, 20 in other ways to give the same results. The common theme of all of these connections is that an approximately equal number of geophone detectors may be combined to make the entire array essentially immune to extraneous broad-front noise sources, which activate the array from outside the protected area.

Those skilled in the art will readily perceive still other modifications; therefore, the appended claims are to be construed to cover all equivalents falling within the spirit and the scope of the invention.

I claim:

1. A self monitoring noise-cancelling intruder detection system comprising an array of vibration detectors interconnected by a two-wire line into a configuration for cancelling wide area noise, means for processing signals originating in said array, transformer means coupled between said array and said signal processing means, means for completing a low level current leakage path across said line to enable said means for processing signals to detect a presence, absence, or significant change in said low level current, and means responsive to signals transmitted from the array through said transformer means to said processor means for signaling alarm conditions in said array.

2. The system of claim 1 wherein said transformer isolates ground loops caused by leakage to ground in said array at frequencies outside the range of frequencies of said low level current.

3. The system of claim 1 wherein said transformer has a ferrite core and operates in an upper-audio frequency range.

4. The system of claim 1 wherein said two-wire line is connected to a primary side of said transformer means, and further comprising oscillator means coupled to the secondary side of said line for providing a carrier wave on which the signal output of said array is modulated by varying the amplitude of the output oscillator level, said modulating signal being proportional to the signal output of said array and occurring responsive to changing the oscillator level by alternately increasing and decreasing the reactive impedance of said transformer means according to the signal output of said array.

5. A noise-cancelling intruder detection system comprising an array of substantially identical vibration detectors which are interconnected by a two-wire line, adjacent ones of said detectors being connected to said line in a manner which mutually cancels their signals when said detectors are driven in-phase, means for processing non-mutually canceled signals originating with said detectors, means for providing a low level current in a leakage path across said line, system monitor means responsive to said leakage current for signaling normal and abnormal conditions on said line, and transformer means for transmitting signals originating in said detectors to said signal processing means.

6. The system of claim 5 and means responsive to signals transmitted through said transformer for signaling intruder alarm conditions.

7. The system of either claim 5 or claim 6 wherein said transformer has a primary winding coupled to said two-wire line and oscillator means coupled to a secondary winding, said signals originating in said detector means modulating the output of said oscillator.

8. The system of claim 7 wherein said transformer has a ferrite core and operates in an upper audio-frequency range.

* * * * *